US008070484B2

(12) United States Patent
Just et al.

(10) Patent No.: US 8,070,484 B2
(45) Date of Patent: Dec. 6, 2011

(54) COMBINATION PULVERIZED FUEL BURNER WITH INTEGRATED PILOT BURNER

(75) Inventors: Tino Just, Freiberg (DE); Christian Reuther, Freiberg (DE); Manfred Schingnitz, Freiberg (DE)

(73) Assignee: Siemens Aktiengesellschaft, Munich (DE)

( * ) Notice: Subject to any disclaimer, the term of this patent is extended or adjusted under 35 U.S.C. 154(b) by 759 days.

(21) Appl. No.: 12/229,325

(22) Filed: Aug. 21, 2008

(65) Prior Publication Data

US 2009/0061372 A1 Mar. 5, 2009

(30) Foreign Application Priority Data

Aug. 29, 2007 (DE) ..... 10 2007 040 890

(51) Int. Cl.
*F23Q 9/00* (2006.01)

(52) U.S. Cl. ..... 431/284; 431/8; 431/12; 431/187; 431/160

(58) Field of Classification Search ..... 431/284, 431/8, 12, 187, 160; 110/347
See application file for complete search history.

(56) References Cited

U.S. PATENT DOCUMENTS 4,857,075 A * 8/1989 Lipp ..... 48/86 R
4,946,475 A * 8/1990 Lipp et al. ..... 48/86 R
5,261,602 A * 11/1993 Brent et al. ..... 239/132.3
6,773,630 B2 * 8/2004 Stellaccio et al. ..... 252/373

FOREIGN PATENT DOCUMENTS

CN 2005 100 79702 6/2005
DE 285 523 12/1990

OTHER PUBLICATIONS

"Lignite and Coal Gasification for Syngas and Energetic Gas Production" Future Energy GmbH/Bayer Technology Services; Gasification Workshop, Beijing, Aug. 5-7, 2004; pp. 1-25, Dipl-Ing. Norbert Fischer of Freiberg.

* cited by examiner

*Primary Examiner* — Alfred Basichas

(57) ABSTRACT

The invention comprises a combination burner for the gasification of pulverized fuels with an oxidation means containing free oxygen at ambient or higher pressures, as well as temperatures between 800-1800° C., with the ignition device of the pilot burner with flame monitoring and the pulverized fuel burner being integrated as a combination burner and all operating channels being routed separately from each other up to the mouth of the burner and the media carried by the channels only being mixed at the mouth of the burner. When the pilot burner is dismantled the eddy bodies 14 attached to its sleeve in the main burner oxidation means supply 17 can be exchanged quickly and easily and thus the main burner flame adapted in the optimum way to the reaction chamber contour of the reactor.

11 Claims, 1 Drawing Sheet

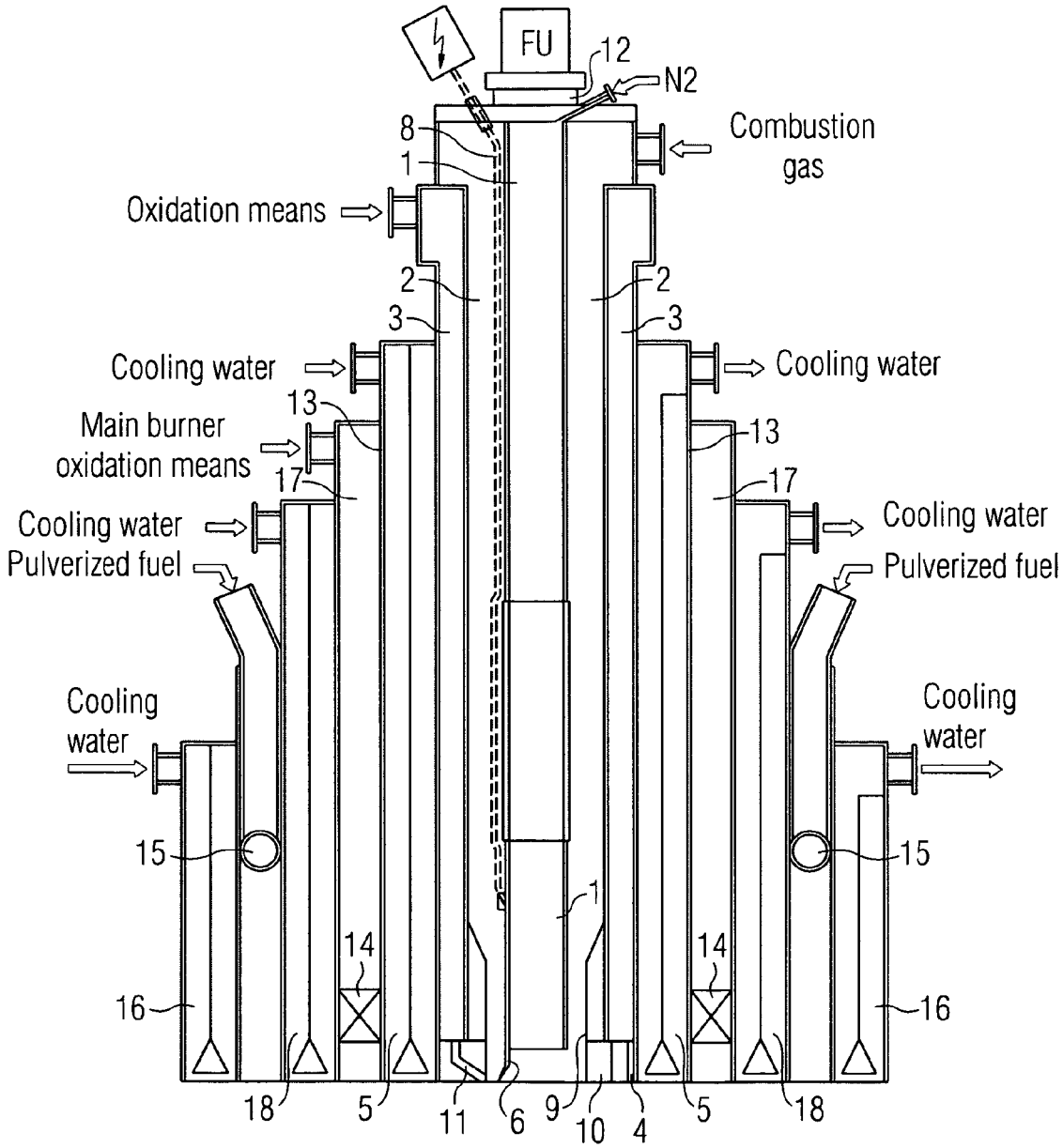
FU
12
N2
8
1
Combustion gas
Oxidation means
2
2
3
3
Cooling water
Cooling water
13
13
Main burner oxidation means
17
17
Cooling water
Cooling water
Pulverized fuel
Pulverized fuel
Cooling water
Cooling water
15
15
1
14
14
16
16
18
5
11
6
9
10
4
5
18

COMBINATION PULVERIZED FUEL BURNER WITH INTEGRATED PILOT BURNER

CROSS REFERENCE TO RELATED APPLICATIONS

This application claims the benefits of German application No. 10 2007 040 890.2 filed Aug. 29, 2007 and is incorporated by reference herein in its entirety.

FIELD OF INVENTION

The invention relates to a combination pulverized fuel burner which is used for oxygen gasification of pulverized fuels (brown coals and/or stone coals or similar pulverized fuels) at high pressures and temperatures in reactors with liquid slag discharges and which operates by means of an integrated pilot burner with gaseous fuel and oxygen and which is put into operation and monitored with an electrical ignition device and optical flame monitoring.

The invention involves a combination burner for the gasification of pulverized fuels with an oxidation means containing free oxygen at pressures between ambient pressure and high pressures of 80 bar (8 MPa) as well as temperatures of between 800-1800° C. with the features of the claims.

BACKGROUND OF THE INVENTION

Pulverized fuel burners for the partial oxidation of pulverized fuels are known which are ignited by an externally-arranged pilot burner.

Patent DD 285 523 describes a generic pilot burner for partial oxidation of gaseous hydrocarbons to gases containing CO and H2 in a pressurized bioreactor.

This pilot burner consists of coaxial channels for combustion gas and oxidation means which are open towards the reaction chamber and are separated or encased by channels through which water flows. Arranged in the combustion gas channel is an ignition cable which is connected to a high-voltage ignition system outside the burner and which, at its end facing towards the reaction chamber, turns into a metallic electrode which is routed up to the burner tip and forms a spark path here to the metallic wall. The electrode of this burner is positioned in the combustion gas channel so that it passes through the confuser, annular nozzle and diffuser forming the nozzle and has its spark path to the metallic wall at the radius of curvature of the diffuser in parallel to the axis, i.e. in the eddy area which forms the transition to the oxygen channel. The arrangement of the metallic electrode is chosen so as to enable the direct ignition of the combustion gas/oxygen on the one hand and on the other hand for the metallic electrode to be cooled by the combustion gas flowing onto it.

The high-voltage ignition cable is introduced into the burner through two separate pressure seals. The pressured area thus produced is used as a safety zone to prevent the escape of combustion gas leaks and is monitored on the pressurized side.

Further combinations of a combination burner consisting of an ignition, pilot and pulverized fuel burner are described in:

Sino German Gasification and CDM Forum held on 5-6 Aug. 2004 in Beijing "Lignite and Coal Gasification for Syngas and Energetic Gas Production" and Chinese Patent Application No. CN 200510079702.4 dated 24 Jun. 2005 from the Beijing Aeronautical Power Inst. "Powder-combustable vortex burner"

The flame signal is transmitted to the monitoring device by means of a multistrand optical fiber cable.

The weaknesses of the known pilot burner are as follows:

The flame signal is transmitted from the reaction chamber to the flame monitor by means of an optical fiber cable, which, because of its proximity to the flame, is subject to thermal stress and can simultaneously also be restricted by soot particles occurring in the field of vision. In addition the metallic electrode located in front of the viewing window obstructs a free view into the reaction chamber.

For reasons of space the metallic electrode must be embodied as a wire which has numerous bends up to its electrode tip. This unstable shape means that the exact adjustments to the sparkover point necessary for ignition can only be made with difficulty. This gives rise to ignition faults and the functional integrity of the burner is not always guaranteed.

The design of the water-cooled nozzle (confuser, cylinder and diffuser) is very complicated and leads especially in the diffuser to thermal stresses which lead to cracks forming in the material and thus to the failure of the burner.

The arrangement of the electrode tip within the diffuser of the nozzle means that an eddy area necessarily forms at this point which mixes proportions of oxygen with the fuel and thus forms an ignitable mixture that can be ignited. It there are media fluctuations during ignition the eddy area moves and thus the mixing point moves as well, which results in ignition faults. This means that there is inherently a high susceptibility to faults.

The combination burner according to the Chinese patent application No. CN 200510079702.4 is further characterized by the pilot burner gas as well as the associated oxygen flowing to the mouth of the burner through a common channel in the center of the burner. The great danger of this is that, if the flow velocity changes, as occurs during start-up and shutdown, a re-ignition occurs in the burner channel, which leads to its destruction, with considerable danger to operating safety.

SUMMARY OF INVENTION

The underlying object of the invention is to create by constructive measures a combination of pilot burner and pulverized fuel burner in one burner unit as a combination pulverized fuel burner, which, by combining the two burners in one unit, guarantees a simpler and safer operation with even flame generation and which greatly reduces the susceptibility to faults.

The object of the invention is the creation of a simple combination pulverized fuel burner with integrated pilot burner which ignites reliably and operates safely under the conditions of pulverized fuel gasification under pressure.

The object is achieved by the features of the claims.

By forming the flame in the central axis of the reactor advantages are obtained compared to the previous solution in respect of total combustion and throughput. At the same time the feeding of media to the head of the reactor is made less complex. With the fitting of the pilot burner into the pulverized fuel burner constructive changes have been made simultaneously to the pilot burner, so that functionally-safe and problem-free operation can be guaranteed.

Advantageous developments of the invention are specified in the subclaims.

BRIEF DESCRIPTION OF THE DRAWINGS

The invention will be explained in greater detail below as an exemplary embodiment, to the extent required to enable it to be understood, with reference to one FIGURE. The FIGURE shows:

FIG. 1 an exemplary embodiment of the inventive combination pulverized fuel burner with integrated pilot burner.

DETAILED DESCRIPTION OF INVENTION

The inventive combination pulverized fuel burner comprises a centrally arranged pilot burner part with separate combustion gas and oxidation means supply in separate channels, a flame monitoring device FÜ and a high-voltage electrical ignition. Arranged around this module is an annular space 13 for supply of the oxidation means for the combination pulverized fuel burner. Arranged at the annular outlet openings are swirler vanes 14 for eddying the stream of oxidation means.

The outer cooling part 5 of the pilot burner in the center and the inner cooling part 18 of the main burner positioned outside it form the main burner oxidation means channel 17. Arranged around this channel and the inner cooling part 18 are the pulverized fuel supply 15 and the cooled outer jacket 16 of the main burner.

The pilot burner includes a centrally arranged tube 1 flushed with inert gas which serves as an optical viewing opening for the flame monitoring device arranged outside the burner, an annular area 2 arranged around the central tube for combustion gas supply, a further annular area 3 for oxidation means supply which is closed on its front face and turns into individual nozzle holes 4 as well as the outer pilot burner part 5 enclosing the entire unit for supply and return of the cooling water. Arranged around the outer cooling channel (5) of the pilot burner is a further tube 13 which serves to accommodate the exchangeable eddying units which are used for directed supply of the main burner with oxidation means.

The centrally arranged tube is routed within the combustion gas channel 2 up to the mouth of the burner and at the end on one side turns into a small, short electrode tip 6, which on ignition allows the ignition sparks to jump to the metal wall of the combustion gas supply in a directed manner. The metallic central tube is electrically interrupted in its front third and connected via a tubular insulation piece 7. The upper part of the central tube is used as a support for the ignition cable 8 introduced via a pressure-sealed entry, with the end of said cable being connected to the burner-mouth side part of the central tube after the insulation piece.

The central tube is flushed with nitrogen in the direction of the reaction chamber in order to prevent hot gases or contaminants from penetrating into the reaction chamber. The central tube is pressure-sealed from the atmosphere with a special quartz glass 12. The optical flame supervision located outside the burner inspects the burner flame through the quartz glass 12 and is thereby protected from thermal stress and contamination particles.

The annular space 2 located around the central tube for supplying the combustion gas is constricted at its exit to form a nozzle (reduced in its diameter). The outer tube delimiting the annular space contains in this area of the nozzle a ceramic insulation ring 9 which brings about the reduction in diameter and prevents an undesired sparkover of the high-voltage ignition from the central tube. Only directly at its outlet is this tube made of metal once more.

The oxidation means for the pilot burner is supplied via the annular space 3. This annular space is sealed where it exits into the reaction chamber with a replaceable screw-in part 10 which is provided with a number of holes 4. These holes 4 can be adapted in their diameter and direction of exit depending on the properties of the combustion gas.

In addition to the holes 4 pointing in the direction of the reaction chamber there are also small holes 11 arranged in the screw-in part 10 which lead into the combustion gas channel.

A small part of the oxidation means is introduced via these two holes into the combustion gas channel. These holes are arranged so that the small amount of oxidation means enters directly above the tip of the electrode in the combustion gas channel and an ignitable gas mixture is formed in this area. Overall a locally fixed and precisely adjustable ignition spark path is formed by the totality of the constructive embodiments which is embodied very stably in its mechanical design.

The oxidation means supply area 3 is encased by a water cooling system 5 which protects the internal parts and the nozzle of the pilot burner against thermal stress.

Around the water cooling 5 of the pilot burner is arranged a further tube 13 which acts as a support for exchangeable eddying bodies 14 in the main burner oxidation means channel. The inventive design of the enclosure around the pilot burner enables the eddying body 14 in the main burner oxidation means supply 17 to be exchanged quickly and easily during dismantling of the pilot burner and thus the main burner flame to be optimally adapted to the reaction chamber contour of the reactor.

The design of the oxidation means supply with eddying bodies means that a strong rotation is imparted to the stream of oxygen coming out, into which the streams of powder exiting via the specially designed supply elements 15 are sucked.

The width and length of the flames generated can be influenced through a different setting of the eddying bodies or swirler vanes.

The invention comprises a combination pulverized fuel burner for the gasification of pulverized fuels with an oxidation means containing free oxygen at ambient or higher pressures, as well as temperatures between 800-1800° C., with the ignition device of the pilot burner with flame monitoring and the pulverized fuel burner being integrated as a combination pulverized fuel burner and all operating channels being led separately from each other up to the mouth of the burner and the two only being mixed at the mouth of the burner.

In a further embodiment of the invention the combination pulverized fuel burner has a cooled outer housing 16 and a pulverized fuel feed 15 of which the inner cooling part 18 serves as the delimitation for accommodating a centrally arranged pilot burner with eddy bodies 14 lying outside it and simultaneously forms the main burner oxidation means channel, with the centrally arranged pilot burner being used for putting into service the pulverized fuel burner unit 15, 16, 17 featuring a central tube 1 as an optical window into the gasification chamber with external flame monitoring, a combustion gas supply 2, an oxidation means supply 3 and a combustion chamber 5.

In a further embodiment of the invention the central tube (1) is routed within the combustion gas channel (2) up to the mouth of the burner and at its exit on one side turns into a small short electrode tip (6), which during high-voltage ignition directs the ignition sparks explicitly to the opposite outer metal wall of the combustion gas supply channel (2).

In a further embodiment of the invention the metallic central tube (1) is interrupted in its front third and connected by an insulator (7).

In a further embodiment of the invention the central tube (1) is sealed from the atmosphere with a quartz glass window (12) and on the unpressurized side supports an optical flame monitor, with it being able to be flushed in the direction of the burner outlet opening with an inert medium, for example nitrogen, in order to prevent hot gases from the reaction chamber from entering.

In a further embodiment of the invention the central tube (1) is used on its outer side as a support the insulated high-voltage ignition cable (8), with the metallic end of the high-voltage ignition cable (8) being connected with the piece of the metallic central tube (1) located close to the mouth of the burner (behind insulator 7), in order to direct the high voltage to the tip of the electrode (6).

In a further embodiment of the invention the combustion gas supply channel (2) in the area of the constriction to the exit nozzle at the outer channel limit has a ceramic insulator (9) in order to prevent an uncontrolled high-voltage spark flashover at the narrow section.

In a further embodiment of the invention the oxidation means supply channel (3) changes in the area of the media outlet by means of a screw-in part (10) with nozzle holes (4) which are able to be adapted according to the desired flame form in their exit direction and angle of exit.

In a further embodiment of the invention additional small holes (11) are arranged in the screw-in part (10) at the oxidation means supply channel which end in the combustion gas channel (2) and in this way direct a small amount of oxidation means immediately above the tip of the electrode (6) in the nozzle area of the combustion gas channel (6) and form a locally-ignitable mixture here which is able to be ignited by the high-voltage ignition sparks.

In a further embodiment of the invention the outer sleeve of the pilot burner forms with the inner cooling part (18) of the main burner part the main burner oxidation means channel (17) which is equipped at the media outlet with replaceable bodies (14) which are attached to the outer sleeve (13) of the pilot burner and with the aid of which the flame geometry in the reaction chamber can be adapted.

In a further embodiment of the invention the pulverized fuel is introduced by one or more tangentially-ending pulverized fuel feed tubes (15) into the combination burner, with the pulverized fuel in the front part of the burner entering into a common pulverized fuel area for the pulverized fuel supply tubes (19) and filling the pulverized fuel annular space here while being rotated and leaving the annular space as evenly-distributed pulverized mist and being intensively mixed before the mouth of the burner with the stream of oxidation means.

The invention claimed is:

1. A combination burner for the gasification of pulverized fuels with an oxidation component containing free oxygen for pressures between ambient pressure and high pressures of 80 bar and temperatures between 800-1800° C., comprising:

a centrally arranged tube that leads to a mouth portion of the burner;

an annular combustion gas channel arranged concentrically around the central tube that leads to the mouth of the burner that provides a combustion gas to the burner;

an annular oxidation component channel arranged concentrically around the annular combustion gas channel that leads to the mouth of the burner and provides an oxidation component to the burner;

an annular cooling channel arranged concentrically around the annular oxidation component channel that provides a coolant to the burner;

a pulverized fuel burner oxidation component annular channel arranged concentrically around the annular cooling channel that provides an oxidant to the burner;

a further annular coolant channel arranged concentrically around the pulverized fuel burner annular channel that provides a further coolant to the burner;

a pulverized fuel annular channel arranged concentrically around the further annular coolant channel that provides pulverized fuel to the burner; and a second further annular coolant channel arranged concentrically around the pulverized fuel annular channel that provides a second further coolant flow.

2. The combination pulverized fuel burner as claimed in claim 1, wherein the central tube supports an ignition tip electrically insulated from the burner.

3. The combination pulverized fuel burner as claimed in claim 2, wherein the insulated ignition tip is insulated by a central tube separated into two tube sections and the tube sections are mechanically connected by a tubular, ceramic insulating body.

4. The combination pulverized fuel burner as claimed in claim 3, wherein the central tube is a support for an insulated high-voltage ignition cable, where a metallic end of the high-voltage ignition cable connected to a section of the metallic central tube located in a vicinity of the mouth of the burner that carries the ignition tip.

5. The combination pulverized fuel burner as claimed in claim 4, wherein the central tube has a pressurized optical viewing window for flame monitoring at an end facing the mouth of the burner and is flushable with an inert gas.

6. The combination pulverized fuel burner as claimed in claim 5, wherein the annular oxidation component channel is closed off on the burner mouth side by an annular screw-in part with nozzle holes.

7. The combination pulverized fuel burner as claimed in claim 6, wherein the combustion gas supply channel has a ceramic insulating cladding in the area of the constriction to the outlet nozzle.

8. The combination pulverized fuel burner as claimed in claim 7, wherein the constriction of the combustion gas supply channel is implemented by the annular screw-in part having a central hole where the central hole has a smaller diameter than an internal diameter of the combustion gas supply channel.

9. The combination pulverized fuel burner as claimed in claim 8, wherein a plurality of small holes are arranged in the screw-in part, which lead into the annular combustion gas channel in the immediate vicinity of the ignition tip.

10. The combination pulverized fuel burner as claimed in claim 9, further comprising a tube arranged around the annular coolant channel where the tube serves as a support for replaceable eddy bodies in the annular channel for the oxidation component of the burner.

11. The combination pulverized fuel burner as claimed in claim 10, wherein the annular channel for the oxidation component of the pulverized fuel burner and the annular channel for the fuel of the pulverized fuel burner are arranged to be mutually interchangeable.

* * * * *